United States Patent [19]

Mondy, Jr.

[11] 4,376,443

[45] Mar. 15, 1983

[54] JET WATER CLEANING APPARATUS

[75] Inventor: Clement R. Mondy, Jr., Houston, Tex.

[73] Assignees: Stewart & Stevenson Services, Inc.; Job-Master Sales, Inc., both of Houston, Tex. ; a part interest

[21] Appl. No.: 295,296

[22] Filed: Aug. 24, 1981

[51] Int. Cl.[3] ..... B08B 3/02

[52] U.S. Cl. ..... 134/168 R; 134/181

[58] Field of Search ..... 134/167 R, 168 R, 172, 134/180, 181

[56] References Cited

U.S. PATENT DOCUMENTS

| | | | |
|---|---|---|---|
| 3,315,691 | 4/1967 | Widner | 134/181 X |
| 3,460,548 | 8/1967 | Giovagnoli | 134/181 X |
| 3,837,011 | 9/1974 | McTighe et al. | 134/168 R X |

FOREIGN PATENT DOCUMENTS

| | | | |
|---|---|---|---|
| 1398283 | 6/1975 | United Kingdom | 134/167 R |

*Primary Examiner*—Robert L. Bleutge

*Attorney, Agent, or Firm*—Fulbright & Jaworski

[57] ABSTRACT

A rigid water conduit is manifold connected to a rotary swivel connection and receives high pressure water therefrom and supplies the water to a plurality of jet nozzles. The jet nozzles are rotated about an axis offset from the nozzles and reciprocating means are connected to the manifold for reciprocating the manifold and nozzles about the swivel connection. The swivel connection includes a housing with a water inlet adapted to be connected to a water pump with a hollow mandrel rotatable in the housing and connected to the manifold and having an opening in communication with the water inlet. A bearing and a seal are provided between the mandrel and the housing on each side of the opening whereby the mandrel may be easily rotated. A track is positioned generally transverse to the manifold and a carriage movable on the track includes a pivoting support having bearings for supporting the mandrel but allowing movement of the mandrel transverse to the carriage. A lead screw is connected to the carriage for reciprocating the carriage and limit switches are positioned for limiting the extent of travel of the carriage in opposite directions. Air motors actuate the lead screw and rotate the jet nozzles. The jet nozzles include a body having a passageway in communication with the nozzles and are carried by a rotating mandrel in a housing which is in fluid communication with the manifold. Bearings and seals between the mandrel and the housing allow the mandrel to be easily rotated by a motor.

10 Claims, 10 Drawing Figures

24
26
28
32
16
30
40
42
34
36
38
42
40
14

110
140
118
142
120
144
122
146
124
148
PILOT
156
152
EXH.
154
EXH.
EXH.
130
92
PILOT
PILOT
126
158
150
132
128
LOGIC
AIR SUPPLY
70
18
AIR IN
112
114
116
114
70
18

JET WATER CLEANING APPARATUS

BACKGROUND OF THE INVENTION

In the past, jet water cleaning has been utilized using high water volumes at intermediate pressures with only reasonable success. However, the prior art apparatus had a reduced cleaning efficiency, required a considerable time for cleaning and also created severe water disposal problems, all of which increased the down time of the equipment being cleaned.

The present invention is directed to various improvements in a jet water cleaning apparatus which is able to use higher pressures with only intermediate water volume but which increases the cleaning effectiveness and rate, minimizes water disposal problems, and requires less equipment down time for cleaning.

SUMMARY

The present invention is directed to providing a jet water cleaning apparatus which has a rigid high pressure water pipe manifold which reduces frictional losses and provides additional safety for operating personnel. The manifold is connected to a rotary swivel connection at one end whereby the manifold may pivot at that end and the swivel connection is adapted to be connected to a water pump for supplying high pressure water to the manifold. A plurality of jet nozzles are connected to the manifold for receiving and dispersing high pressure water and the jet nozzles are rotated about an axis offset from the nozzles thereby creating increased agitation and pulsation of a blast of water which increases the cleaning effectiveness and rate. Means are connected to the manifold for reciprocating the manifold and nozzles about the swivel connection for moving the jet cleaning water across the surface of the object to be cleaned.

A further object of the present invention is the provision of a rotary swivel which includes a housing having a water inlet and a hollow mandrel rotatable in the housing and connected to the manifold and having an opening in communication with the water inlet. A bearing and a seal is positioned between the mandrel and the housing on each side of the opening whereby the mandrel may be easily rotated even when receiving high pressure water as the water pressure acting in the mandrel is substantially balanced.

Still a further object of the present invention is the provision of reciprocating means which includes a track positioned generally transverse to the manifold in which a carriage is movable on the track. The carriage includes a support pivotally connected to the carriage and the support includes bearings for supporting the manifold but allows movement of the manifold generally transverse to the carriage as the carriage moves along the track. Preferably, the track is perpendicular to the manifold when the manifold is mid-way in its reciprocating movement about the rotary swivel.

Yet a still further object is the provision of a lead screw connected to the carriage for reciprocating the carriage and limit switches positioned on the track spaced from each other limiting the extent of travel of the carriage along the track in opposite directions.

Still a further object of the present invention is the provision of air motors actuating the lead screw and rotating the jet nozzles which are more satisfactory in highly humid environments than electrically controlled devices.

A still further object of the present invention is wherein the nozzles and motor for rotating the nozzles includes a body supporting the nozzles in which the body has a fluid passageway in communication with the nozzles. A hollow mandrel is connected to the body and in fluid communication with the passageway and is rotatably enclosed and supported in a housing. The housing includes a fluid inlet connected to the manifold and the mandrel has an opening in communication with the fluid inlet. Bearings and seals are provided between the mandrel and the housing on each side of the opening for easily rotating the mandrel even when receiving high pressure water and a motor is connected to the mandrel for rotating the nozzle. Preferably, a second set of jet nozzles is connected to the manifold and rotated for cleaning an increased area.

Still a further object of the present invention is the provision of a pump connected to the rotary swivel providing at least 5000 psi water pressure and less than 300 gallons of water per minute of water.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

While the present jet water cleaning apparatus is suitable for cleaning various types of equipment, for purposes of illustration only, the present invention will be described in use as cleaning an air preheater for removing insoluble material, such as slag, refractory, porous clinkers, popcorn type material or pellet-like particles, and fly ash from the preheater.

Figure 1:
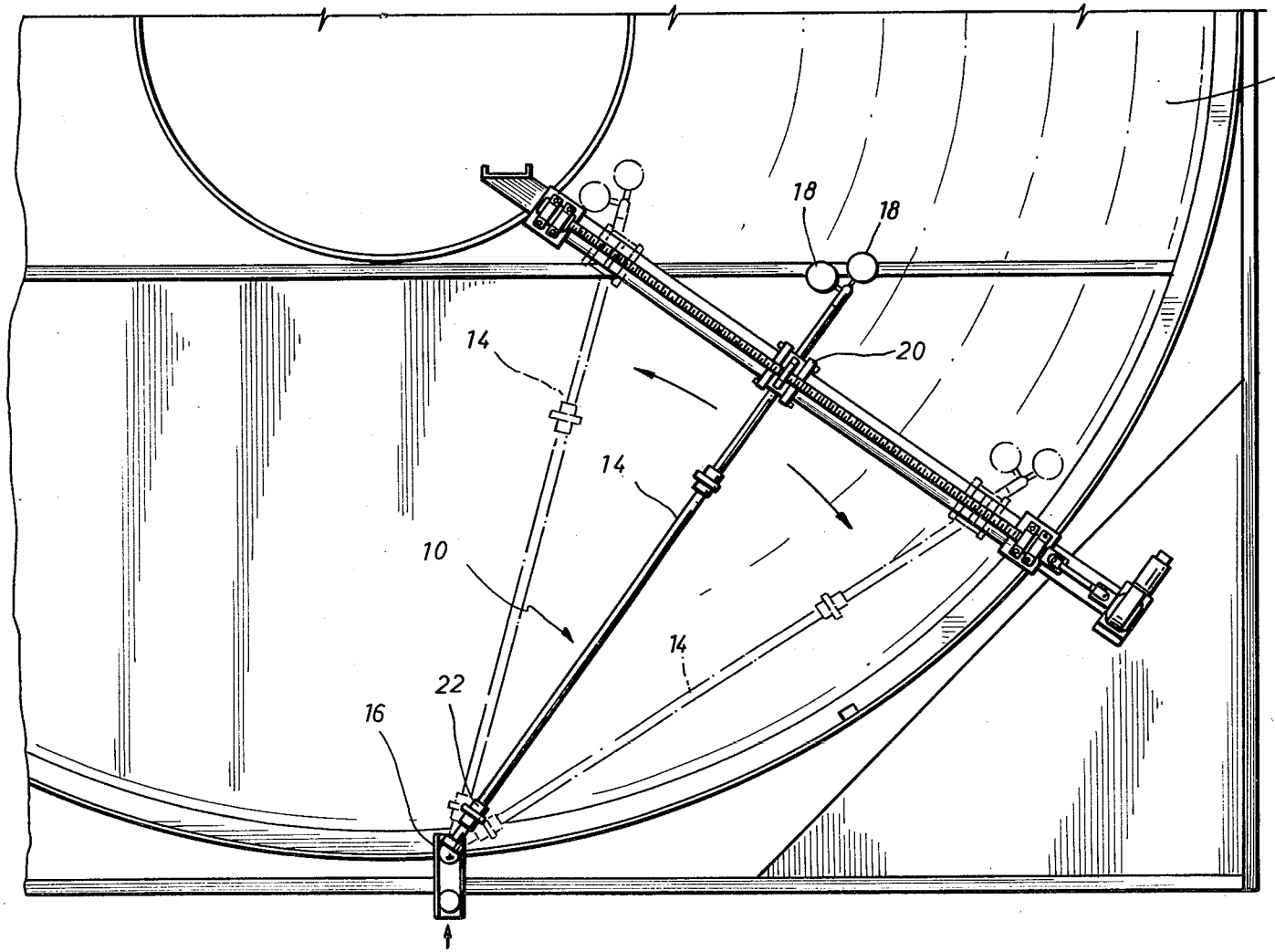
FIG. 1 is a fragmentary elevational view illustrating the apparatus of the present invention in position for cleaning an air preheater.

Referring now to FIG. 1, the present apparatus is generally referred to by the reference numeral 10 for cleaning a vertical preheater 12, such as a Ljungstrom preheater, which is a rotatable preheater used in power plants. The preheater 12 is tubularly shaped with a horizontal thickness of approximately 12 feet and rotates between the exhaust outlet in the power plant to pick up heat and through an air inlet for warming the incoming air with the heated preheater. However, the preheater or heat exchanger 12 becomes heavily fouled from the exhaust particles of combustion and must be periodically cleaned. However, it is desirable that they be cleaned thoroughly, quickly, with a minimum of water disposal problems and lower future deposit accumulations for reducing future replacement costs and for reducing maintenance costs.

The apparatus 10 generally includes a rigid water conduit manifold 14 which is connected to a rotary swivel connection 16 which is adapted to be connected to a water pump for supplying high pressure water to the manifold, one or more jet nozzle assemblies 18 for receiving and dispersing high pressure water, and reciprocating means 20 connected to the manifold for reciprocating the manifold 10 and the jet nozzle assemblies 18 across the preheater 12.

In the past high water volumes at intermediate pressures have been employed with only reasonable success. With the present invention, using high pressure and intermediate volumes (200 to 300 gallons per minute at 5000 to 6000 psig) cleaning efficiency and cleaning rates are increased with less down time and water disposal problems are minimized. The rigid water conduit 14 manifold, which in one embodiment is a two inch metal water pipe connected by conventional pipe couplings 22, reduces high frictional losses throughout the system 10 and provides additional safety for operating personnel. By reducing hydraulic horsepower losses due to friction results in higher cleaning effectiveness at faster rates at the nozzle assemblies 18.

Figure 2:
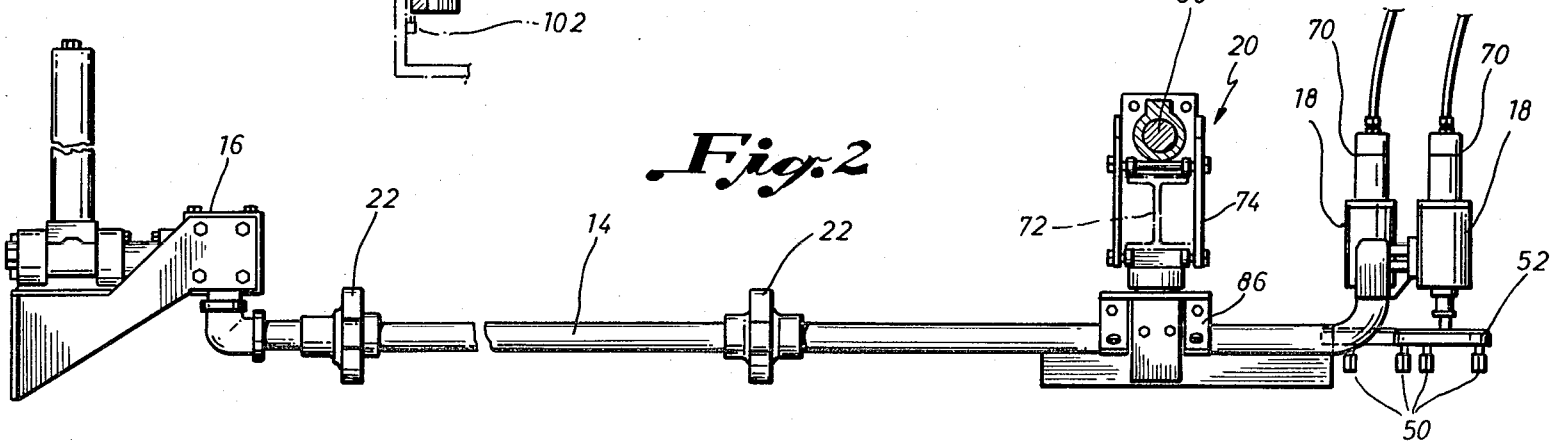
FIG. 2 is an enlarged elevational view, partly in cross section, illustrating the jet cleaning apparatus of the present invention.
Figure 7:
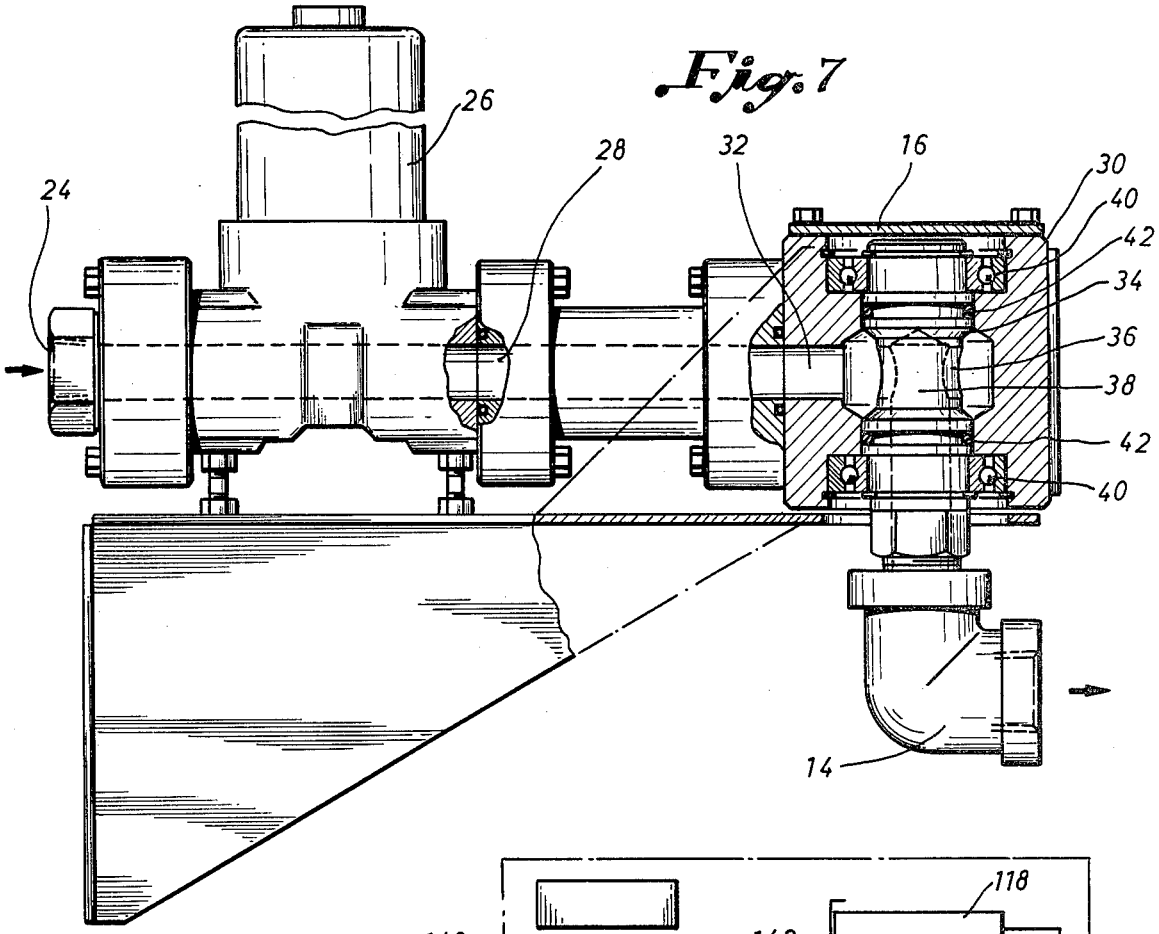
FIG. 7 is an elevational view, partly in cross section, illustrating the rotary swivel connection.

Referring now to FIGS. 1, 2 and 7, the rotary swivel connection 16 is best seen which generally includes an inlet 24 which is adapted to be connected to a suitable water pump for supplying the high pressure water for the apparatus 10. The water flows through a filter 26 and through a passageway 28 to a housing 30 which has a water inlet 32. A hollow mandrel 34 is rotatable in the housing 30 and is connected to the manifold 14 and includes a plurality of openings 36 in communication with the water inlet 32. The mandrel 34 includes a passageway 38 leading from the openings 36 to the manifold 14. A bearing 40 and a seal 42 are provided between the mandrel 38 and the housing 30 on each side of the openings 36 whereby the mandrel 38 is substantially pressure balanced in the housing 30 and may be easily rotated even when receiving high pressure water whereby the manifold 14 and nozzle assemblies 18 (FIG. 1) may be reciprocated about the rotary swivel connection 16.

Figure 6:
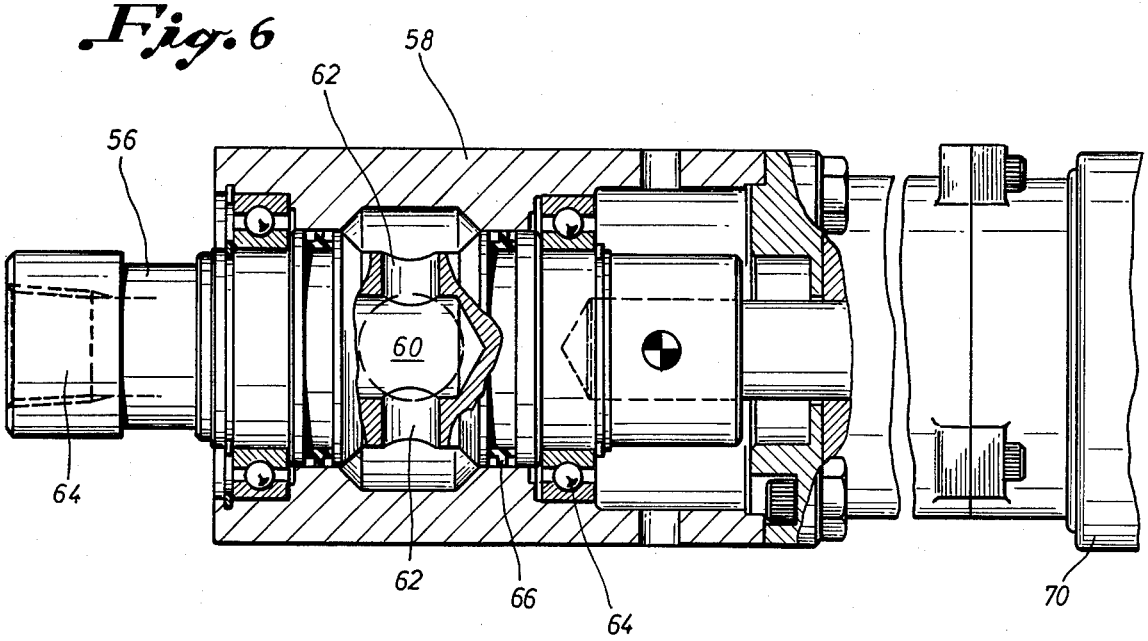
FIG. 6 is an elevational view, partly in cross section, illustrating the rotating mechanism for supporting a set of jet nozzles.
Figure 4:
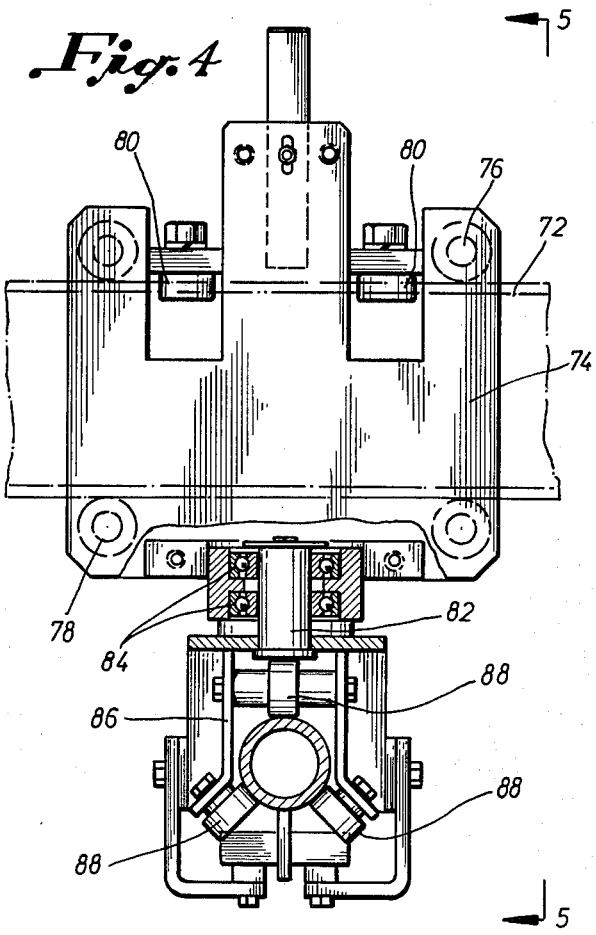
FIG. 4 is an enlarged elevational view, partly in cross section, illustrating the carriage of the present invention.
Figure 5:
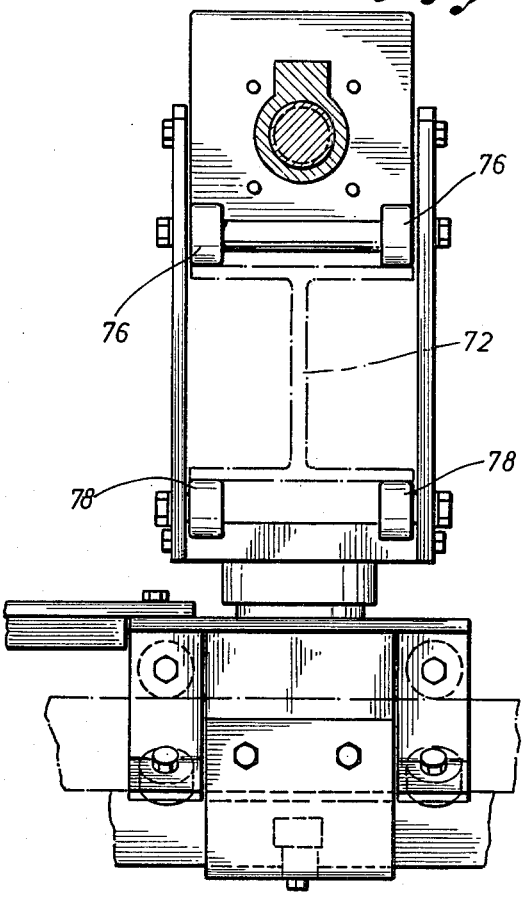
FIG. 5 is a cross-sectional view taken along the line 5—5 of FIG. 4.
Figure 10:
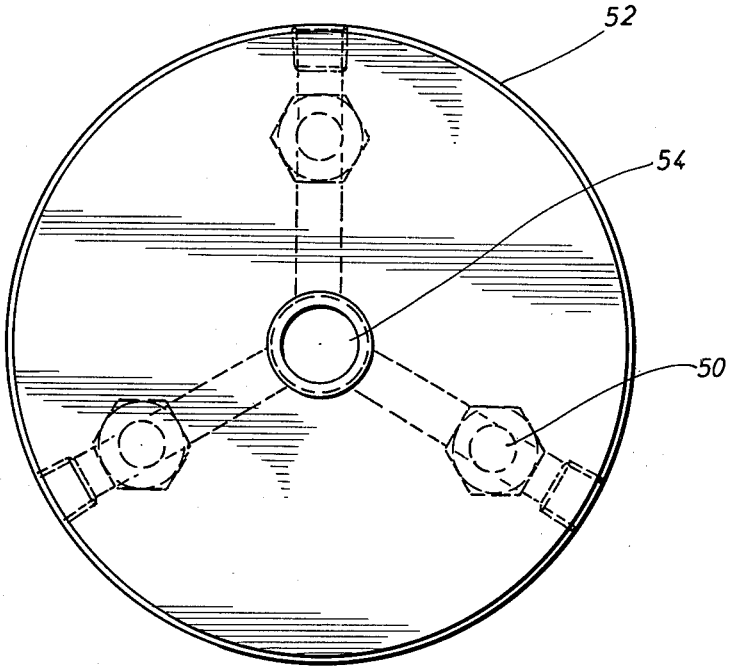
FIG. 10 is a cross-sectional view taken along the line 10—10 of FIG. 9.
Figure 9:
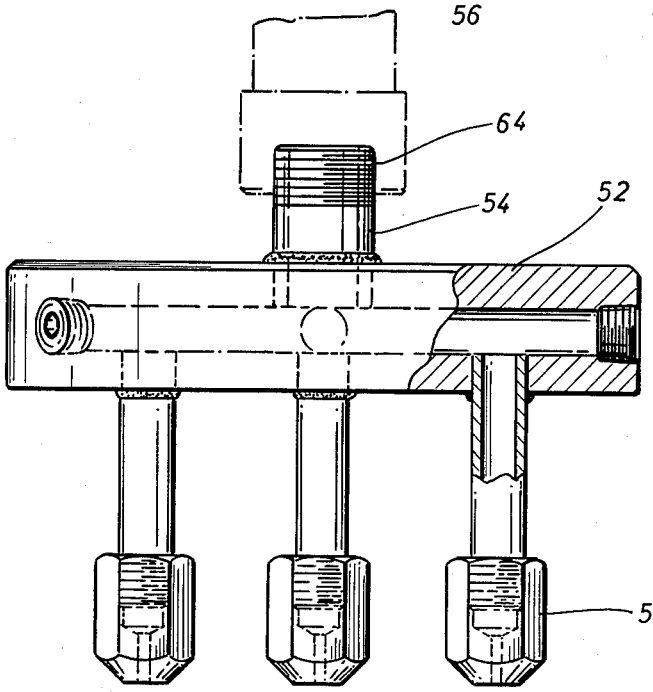
FIG. 9 is an elevational view of one of the nozzle plates.

Referring now to FIGS. 1, 2, 9 and 10, water from the manifold 14 is received and dispersed by the jet nozzle assemblies 18. While a single assembly 18 could be utilized, it is preferable to utilize two assemblies 18 to provide greater cleaning action. Each assembly 18 includes a plurality of jet nozzles 50, for example, three. As best seen in FIGS. 9 and 10, the jet nozzles 50 are connected to a body 52 having a fluid passageway 54 therein which is in fluid communication with the nozzles 50. The body 52 is connected to a hollow mandrel 56 (FIG. 6) which is rotatably supported in a housing 58 which has a water inlet 60 connected to the manifold 14. The mandrel has one or more openings 62 in fluid communication with the water inlet 60 for conducting water from the manifold to a mandrel passageway 64 to the fluid passageway 54 in the body 52 leading to the jet nozzles 50. A bearing 64 and a seal 66 are provided between the mandrel 56 and the housing 58 on both sides of the openings 62 whereby the mandrel is pressure balanced and may be easily rotated when receiving high pressure water. The mandrel 56 is connected to a motor 70, preferably a pneumatic motor, which rotates the mandrel 56, the body 52 and the jet nozzles 50 about the axis of the mandrel 56 which is offset from the axis of the nozzles 50. The rotating water jet nozzles 50 provide increased agitation for increasing the cleaning effectiveness and cleaning rate as they are rotated to provide blasts of water hitting the preheater 12. Preferably, the nozzles 50 are not on the same radius from the center so they will clean different areas as they rotate. By utilizing more than one jet nozzle assembly 18, a greater area is simultaneously cleaned. The plurality of assemblies 18 are positioned adjacent to each other for cleaning a wide area on the preheater 12 as the reciprocating means 20 moves the nozzle assemblies 18 across the surface of the preheater 12.

Referring now to FIGS. 1–5, the reciprocating means 20 may include a track 72 which is positioned generally transverse to the manifold 14 and is preferably perpendicular to the manifold 14 when the manifold 14 is in its mid-position of travel as best seen in FIG. 1. For example, the track 72 may be a conventional H-beam. A carriage 74 is provided which is movable on the track 72 and is supported thereon by a plurality of top rollers 76, bottom rollers 78 and side rollers 80. The carriage 74 includes a support 82 pivotally connected to the carriage 74 and supported by thrust bearings 84. The pivoting support 82 carries a swiveling frame 86 having a plurality of roller bearings 88 for supporting the water manifold 14. Thus, as the carriage 74 moves on the track 72 and reciprocates as shown in FIG. 1, the pipe manifold may be reciprocated and is allowed to rotate relative to the carriage 74 by the pivoting support 82 and may move generally transversely through the carriage 74 on the roller bearings 88.

Figure 3:
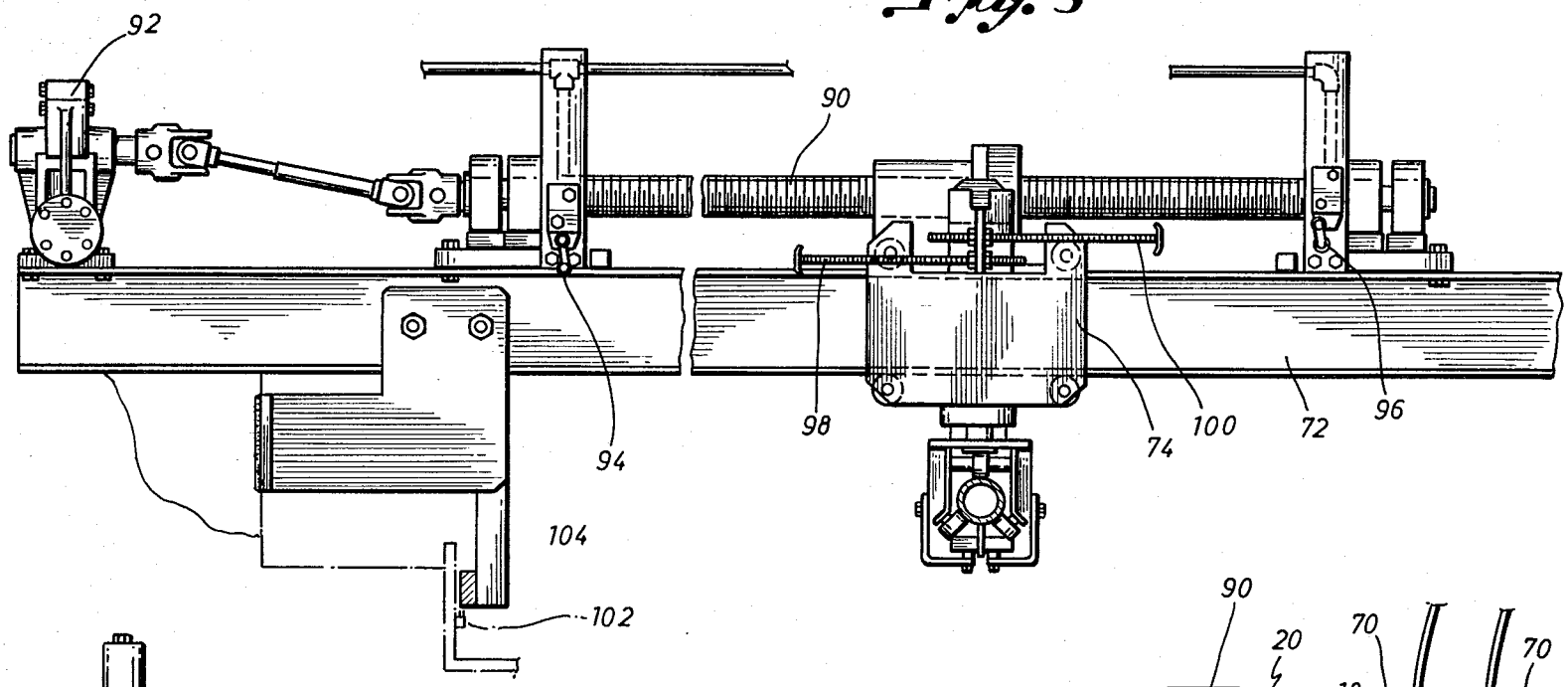
FIG. 3 is an enlarged fragmentary elevational view of the carriage and track arrangement of the present invention.

Referring now to FIG. 3, suitable means for moving the carriage 74 along the track 72 may be a lead screw 90 which is actuated by any suitable means such as a pneumatic motor and gear box 92. Rotation of the lead screw 90 will move the carriage in one direction and reverse rotation of the lead screw 90 will move the carriage 74 and manifold 14 in the opposite direction. A first limit switch 94 is provided at one position on the track 72 and a second limit switch 96 is provided at another position on the track 72. The limit switches 94 and 96 are actuated by trip rods 98 and 100, respectively, carried by the carriage 74 and in turn act in a control circuit for stopping or reversing the lead screw 90 for controlling the extent of travel of the carriage 74.

The preferred method of cleaning is to rotate the preheater 12 and after each rotation the carriage 74 is moved either inwardly or outwardly an incremental distance equal to the cleaned area to water blast another circular area of the preheater 12. Referring still to FIG. 3, a limit switch 102 is provided connected to the support 104 from the track 72 and a trip (not shown) is connected to the rotating preheater 12 so that it will contact the limit switch 102 upon each revolution of the preheater 12 to cause the carriage 74 to be moved over an incremental distance approximately equal to the water cleaning path of the jet assemblies 18. In operation, the rotation of the preheater 12 may be set at approximately one-fourth of a revolution per minute and a typical automatic cleaning cycle is about two hours. The number of cleaning cycles is determined by a visual inspection of the preheater 12. However, with the present invention three to five automatic cleaning cycles are normally required depending upon the ash level in the preheater at the time of cleaning.

Figure 8:
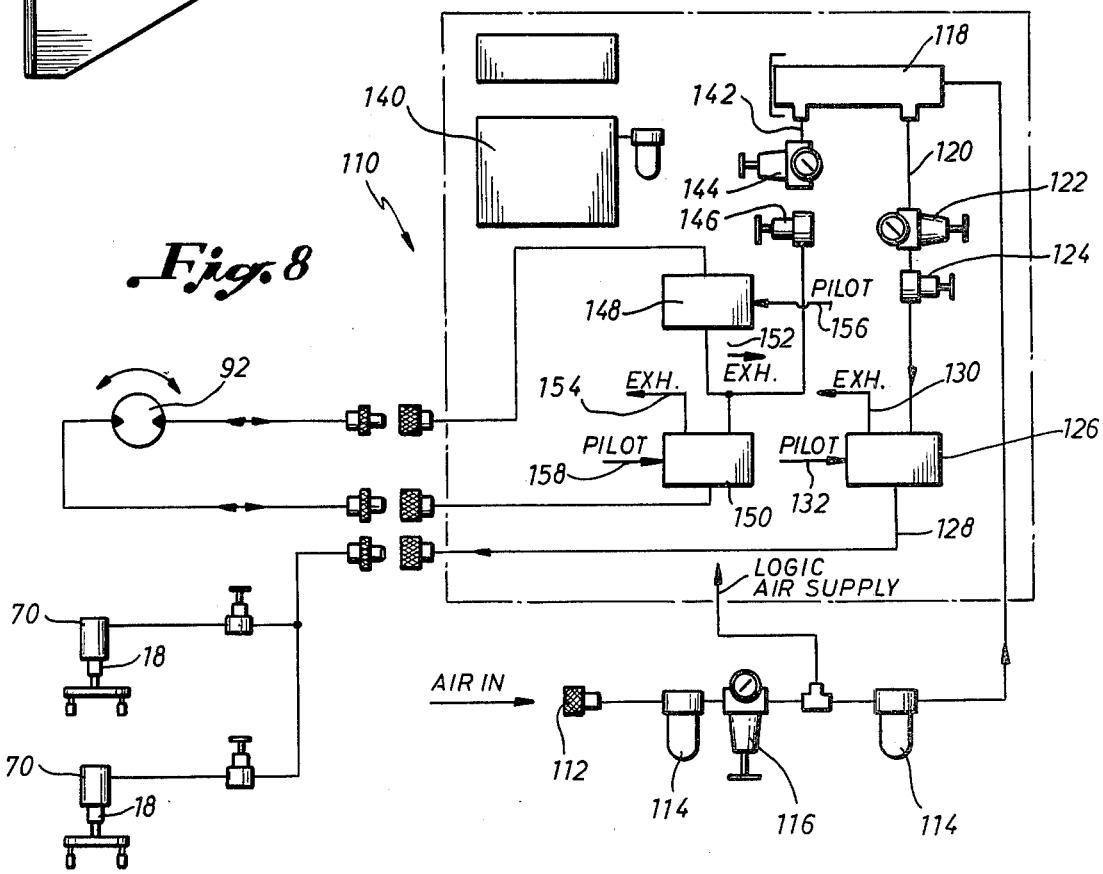
FIG. 8 is a schematic diagram of the schematic control system of the present invention.

While any suitable control circuit may be used to actuate and control the jet cleaning apparatus 10 of the present invention, air or hydraulic systems are preferred for use in the highly humid environment found in water blasting applications. The preferred control system is pneumatic and operates pneumatic motor 92 for reciprocating the carriage 74 and pneumatic motors 70 for rotating the nozzle assemblies 18. Referring now to FIG. 8, an air control system 110 is best seen which utilizes an air source having an inlet 112 which is filtered in filters 114 and passes through a lubricator 116. The incoming air is passed through a manifold 118. One line 120 flows through a regulator 122 and a needle valve 124 to an air valve 126. Valve 126 has an outlet 128 supplying air to actuate the motors 70 for rotating the nozzle assemblies 18, an exhaust port 130 and a pilot line 132 which is connected to the air logic system 140 for actuating the valve 126 when the system 110 is turned on.

Another line 142 from the manifold 118 passes through a regulator 144, a needle valve 146, and then to the inlet of two air valves 148 and 150. The valves 148 and 150 include exhaust lines 152 and 154, respectively, and each includes a pilot line 156 and 158, respectively, which is connected to the air logic system 140. The valves 148 and 150 provide air for rotating the motor 92 and the lead screw 90 in a first or second direction.

The air logic 140 is an air logic control system Model No. IDCS789-0 sold by Dynamco, which receives indications from the limit switches 94, 96 and 102 to incremently move the carriage and jet nozzle assemblies 18 in incremental units and to reverse the movement by the lead screw 90 upon reaching the end of travel.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts, will readily suggest themselves to those skilled in the art and which are encompassed within the spirit of the invention and the scope of the appended claims.

What is claimed is:

1. A water cleaning apparatus comprising, a rigid water conduit manifold, a rotary swivel connection attached to one end of the conduit whereby said conduit may pivot at said one end, said swivel connection adapted to be connected to a water pump for supplying high pressure water to the manifold, a plurality of jet nozzles connected to the manifold for receiving and dispersing high pressure water, means for rotating the jet nozzles about an axis offset from the axis of said nozzles, and means connected to the manifold for reciprocating said manifold and nozzles about the swivel connection.

2. The apparatus of claim 1 wherein the rotary swivel includes, a housing having a water inlet, a mandrel rotatable in the housing and connected to the manifold and having an opening in communication with the water inlet, a bearing and a seal between the mandrel and the housing on each side of the opening whereby the mandrel may be easily rotated even when receiving high pressure water.

3. The apparatus of claim 1 wherein the reciprocating means includes, a track positioned generally transverse to the manifold, a carriage movable on the track, said carriage including a support pivotally connected to the carriage, said support including bearings for supporting the manifold but allowing movement of the manifold generally transverse to the carriage.

4. The apparatus of claim 3 including, a lead screw connected to the carriage for reciprocating the carriage, and limit switches positioned on the track spaced from each other limiting the extent of travel of the carriage along the track in opposite directions.

5. The apparatus of claim 3 including, air motors actuating said lead screw and rotating the jet nozzles.

6. The apparatus of claim 1 wherein said nozzles and the means for rotating the nozzles includes, a body supporting said nozzles, said body including a fluid passageway in communication with the nozzles, a mandrel connected to the body and in fluid communication with the passageway, a housing enclosing and rotatably supporting one end of the mandrel, said housing having a fluid inlet connected to the manifold, said mandrel having an opening in communication with the fluid inlet, a bearing and seal between the mandrel and the housing on each side of the opening whereby the mandrel may be easily rotated even when receiving high pressure water, and motor means connected to the mandrel for rotating the nozzles.

7. The apparatus of claim 1 including, a second set of jet nozzles connected to the manifold and means for rotating the second set of nozzles.

8. The apparatus of claim 1 including a pump connected to the rotary swivel providing at least 5000 psi water pressure and less than 300 gallons per minute water.

9. A water cleaning apparatus for cleaning a rotating vertical air preheater comprising, a rigid water conduit manifold positioned above the upper end of the preheater, a rotary swivel connected attached to one end of the conduit whereby said conduit may pivot at said one end and move across the upper end of the rotating preheater, said swivel connection adapted to be connected to a water pump for supplying high pressure water to the manifold for cleaning the preheater, a plurality of jet nozzles connected to the manifold for receiving and dispersing high pressure water onto the preheater, means connected to the manifold for incrementally reciprocating said manifold and jets about the swivel connection and across the upper end of the preheater, said means including means for incrementally moving said manifold and nozzles upon each rotation of the preheater.

10. A water cleaning apparatus comprising, a rigid metal water conduit manifold, a rotary swivel connection including, a housing having a water inlet adapted to be connected to a water pump for receiving high pressure water, a hollow mandrel rotatable in the housing and connected to the manifold and having an opening in communication with the water inlet, a bearing and a seal between the mandrel and the housing on each side of the opening whereby the mandrel may be easily rotated even when receiving high pressure water, a plurality of rotating jet nozzles connected to the manifold for receiving and dispersing high pressure water including, a body supporting said nozzles, said body including a fluid passageway in communication with the nozzles, a hollow mandrel connected to the body and in fluid communication with the passageway, a housing enclosing and rotatably supporting one end of the mandrel, said housing having a fluid inlet connected to the manifold, said mandrel having an opening in communication with the fluid inlet, a bearing and seal between the mandrel and the housing on each side of the opening whereby the mandrel may be easily rotated even when receiving high pressure water, and motor means connected to the mandrel for rotating the nozzles, means connected to the manifold for reciprocating the manifold and nozzles about the swivel connection including, a track positioned generally transverse to the manifold, a carriage movable on the track, said carriage including a support pivotally connected to the carriage, said support including bearing for supporting the manifold but allowing movement of the manifold generally transverse to the carriage.

* * * * *